United States Patent [19]

Russell et al.

[11] Patent Number: 4,955,679

[45] Date of Patent: Sep. 11, 1990

[54] INFORMATION ORGANIZER

[76] Inventors: Herman F. Russell, P.O. Box 334, La Center, Ky. 42056; Ray E. Lynn, Rte. 1, Box 218, Wickliffe, Ky. 42087

[21] Appl. No.: 417,908

[22] Filed: Oct. 6, 1989

[51] Int. Cl.[5] ..... A47B 81/00

[52] U.S. Cl. ..... 312/321.5; 283/67; 312/39; 312/234.3

[58] Field of Search ..... 312/326, 234, 234.3, 312/39, 329, 321.5; 40/618, 107; 108/6; 281/5, 31; 283/67

[56] References Cited

U.S. PATENT DOCUMENTS

| | | | |
|---|---|---|---|
| D. 91,541 | 2/1934 | Pedersen . | |
| 209,728 | 11/1878 | Taggart | 312/234.3 |
| 623,023 | 4/1899 | Kelly | 312/234 X |
| 720,829 | 2/1903 | Markell | 281/5 |
| 2,964,370 | 12/1960 | Butler | 312/234 X |
| 3,246,612 | 4/1966 | Ballas | 108/6 |
| 4,795,196 | 1/1989 | Hyun et al. | 283/67 |
| 4,852,910 | 8/1989 | Taffer | 283/67 |
| 4,861,121 | 8/1989 | Gotz | 312/7.2 X |

*Primary Examiner*—Joseph Falk

*Attorney, Agent, or Firm*—Dennison, Meserole, Pollack & Scheiner

[57] ABSTRACT

An information center including a vertically elongate open front housing having vertically aligned storage compartments therein. The upper portion of the housing, for a major portion of the height thereof, is selectively closed by a closure which in turn incorporates a lower enlarged calendar-receiving pocket, a digital timepiece immediately above the lower pocket, multiple transversely aligned smaller pockets above the digital timepiece, and an upper enlarged analog clock. The lower portion of the housing mounts an adjustable writing desk.

5 Claims, 2 Drawing Sheets

FIG. 3.
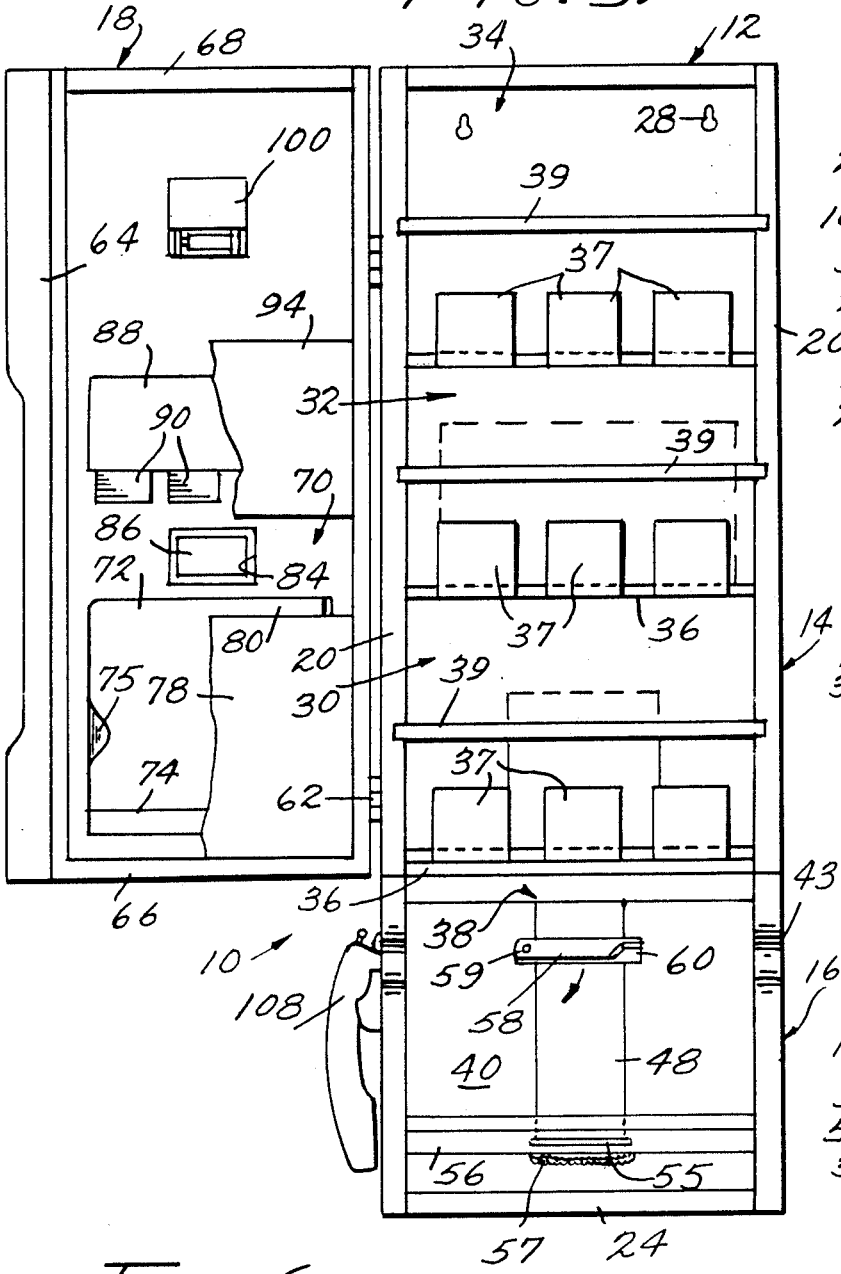
FIG. 4.
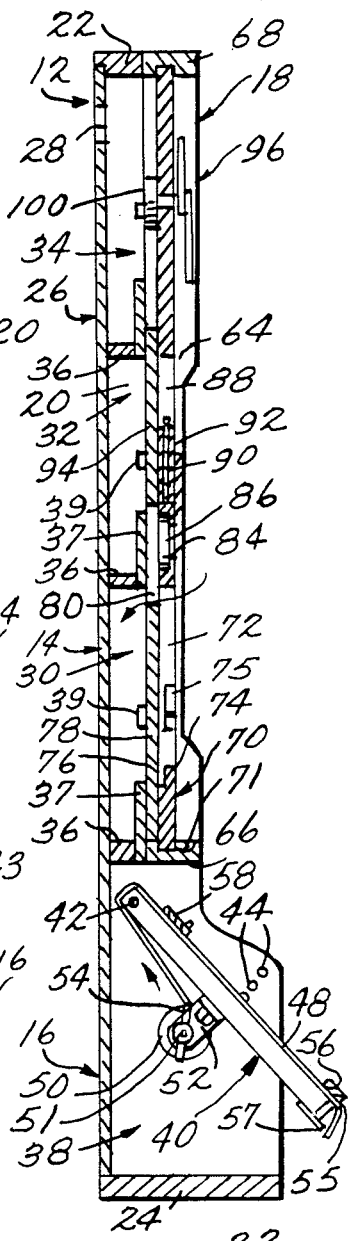
FIG. 6.
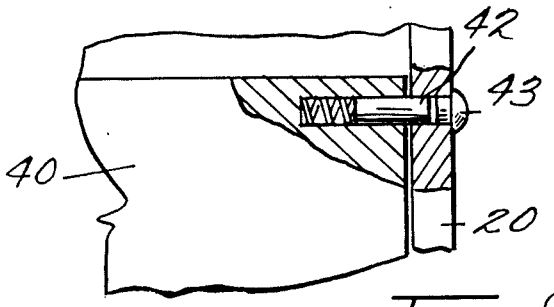
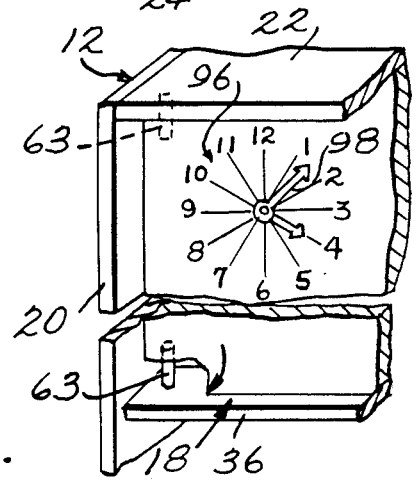
FIG. 8.

INFORMATION ORGANIZER

BACKGROUND OF THE INVENTION

The present invention broadly relates to means for maximizing utilization of space and organizing information.

The organization of information in the home, particularly as it relates to bill paying, the collection of tax information, the tracking of important dates, and the like is frequently rather haphazard and not centralized or coordinated in any particularly efficient manner, often resulting in lost information, missed dates, and the like.

In addition, the problem of proper information organization is frequently increased by the lack of readily accessible storage space in conjunction with facilities for both making the information readily available and providing means for acting on the information. The problem is particularly acute when space is limited such as in mobile homes and the like.

SUMMARY OF THE INVENTION

The organizer of the present invention provides, in a single unit, an information center which incorporates multiple means for indicating time and date, reminder information for tracking important dates, selectively useable storage components for coordinated collection and segregation of paperwork, and a writing desk with paper supply for use in conjunction with the organizer information, or for such other general purposes as may be desired.

The organizer or organizer center is particularly adapted for wall mounting and is readily accommodated on substantially any useable vertical wall surface. The organizer has a narrow silhouette with the components thereof generally vertically aligned to enhance its accommodation in limited space.

In providing for the multiple functions and capabilities as or in a self-contained unit, the organizer comprises a vertically elongate housing with an open forward face. The housing includes an upper section divided into vertically aligned storage compartments, and a lower section defining a writing area with a mounted desk, preferably provided with its own paper supply.

A closure is mounted on the upper housing section for selective movement between a first position overlying and closing the open face thereof, and a second open position exposing the internal storage compartments. The closure itself mounts the various information-supplying components, including an enlarged analog clock for maximum visibility, a smaller digital clock primarily intended for indicating the date, and a calendar preferably comprising individual pocketed sheets for each month. Both the digital clock and the calendar are located adjacent to the desk and readily visible by a user of the desk.

An access slot is provided through the closure adjacent the calendar and aligned with the upper portion of the lowermost storage compartment for the introduction of materials, for example bills-to-be-paid, into the storage compartment. It is contemplated that as the bills are paid, for example on a monthly basis, the paid bills are stored in the corresponding month folder with the folder, upon conclusion of the month, being stored in a second of the storage compartments and retained as a source of tax information or the like. This compartment is accessible upon an opening of the closure.

A third housing compartment can be used for, as an example, greeting cards of various types in anticipation of coming occurrences such as birthdays, anniversaries, and the like.

As a means for providing the user or users of the organizer with a reminder of important dates, the closure includes several pockets accessible from the front face thereof. A plurality of cards or card-like elements will be stacked in each pocket with the cards each having a reminder date thereon and being so arranged whereby upon the reaching of the date of the forwardmost card, the card is moved to the back of the stack, thus revealing a subsequent card bearing the next approaching significant date. The cards, with the dates thereon are clearly visible from the face of the organizer and provide a constant reminder of the significant dates in conjunction with an immediately adjacent digital date indicator and calendar. As desired, the individual pockets can be used for separate purposes, for example one pocket for birthdays, another for anniversaries, a third for important bill paying dates, and the like.

The desk in the lower writing section of the housing can be adjustable, swinging from a stored position to any of a plurality of outwardly angled writing positions. In addition, an appropriate paper supply can be mounted on the desk.

Other features of the invention, along with the advantages attributable thereto, will become apparent from the more detailed description of the invention following hereinafter.

BRIEF DESCRIPTION OF THE DRAWINGS

FIG. 3 is a front view of the organizer with the closure swung to an open position, and with selected portions broken away for purposes of illustration;

FIG. 4 is a cross-sectional view taken substantially on a plane passing along line 4—4 in FIG. 1;

FIG. 6 is a partial detail illustrating a proposed manner of mounting the desk;

FIG. 8 is a perspective detail of an alternate manner of mounting the closure.

DESCRIPTION OF THE PREFERRED EMBODIMENT

Figure 1:
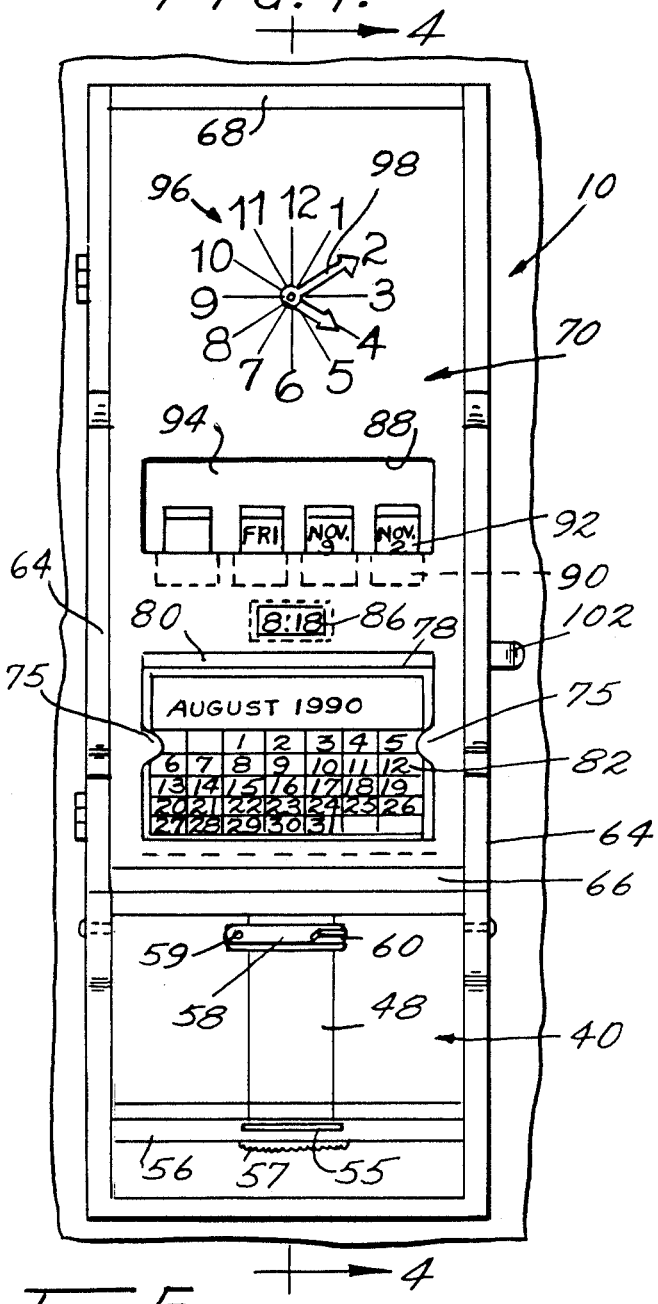
FIG. 1 is a front elevational view of the organizer of the invention.

Referring now more specifically to the drawings, the organizer or organizer center 10 is a self-contained assembly including a vertically elongate housing 12 comprising upper and lower open-faced sections 14 and 16. The upper housing section 14, which comprises a major portion of the height of the housing 12, is selectively closed by a closure 18 in the nature of a vertically elongate panel assembly provided as the primary information-bearing member and pivotally mounted for selectively opening and closing the upper section 14 of the housing 12.

The housing 12 includes a pair of vertically elongate side boards 20 of a constant depth, for example approximately 3 to 4 inches, for the full height of the upper section 14, and substantially deeper, through integral forward extensions, along the lower vertical extents thereof corresponding to the lower section 16. The upper and lower ends of the side boards 20 are interconnected, respectively, by top and bottom boards 22 and 24, each of a depth substantially coextensive with the depth of the corresponding ends of the side boards so as to present a coplanar front edge therewith. The rear face of the housing 12 is closed by a secured back panel 26 coextensive with at least the upper section 14 and preferably with the full height of the housing 12. As a means for conveniently mounting the organizer 10, the back panel 26, adjacent the upper edge thereof, can be provided with appropriate keyhole slots or the like 28 for engagement over wall-mounted screws. Other appropriate mounting means can also be utilized in an obvious manner.

The upper section 14 is divided into at least three vertically aligned full-width storage compartments, a lower compartment 30, a middle or central compartment 32, and an upper compartment 34. Each compartment is defined by a bottom shelf or shelf ledge 36 extending between and secured to the opposed side boards 20. Each compartment includes means for retaining materials, preferably papers, therein. Such means may comprise one or more vertical retainer panels 37 fixed to each shelf 36 at or adjacent the front edge thereof and extending vertically therefrom for a minor portion of the height of the corresponding storage compartment, and/or a transverse strap 39 extending between and secured to the front edges of the opposed side boards 20 at approximately mid-height of the storage compartments.

Figure 7:
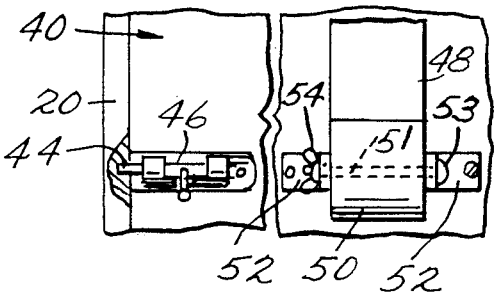
FIG. 7 is an undersurface detail of a portion of the desk illustrating the positioning lock for the desk and the paper supply means.

The lower section 16 of the housing 12 includes a single enlarged forwardly opening compartment 38 which receives a writing desk 40. The desk 40 is preferably pivotally mounted, for example by a pair of oppositely directed spring-loaded pins 42 extensible from the upper side corners thereof for engagement within appropriate bores in the facing sides of the side boards 20. As noted in FIG. 6, for removal of the desk 40, the pins 42 are accessible from the outer ends of the side wall bores. These outer ends can be selectively closed by end plugs 43. Mounted in this manner toward the upper end of the compartment 38, the writing desk can selectively pivot between a substantially vertical position for compact storage within the compartment and an upwardly swung forwardly angled position for use as a writing surface. As suggested in FIGS. 2, 4 and 7, the desk is positionable in any of a plurality of swung positions defined by an arcuate series of sockets 44 in one or both of the facing sides of the side boards 20, the sockets 44 in turn receive sliding lock bolts 46 mounted on the undersurface of the desk 40. As will be appreciated, the point of pivotal mounting of the desk can vary as long as the range of pivotal movement, between a vertical stored position and any of several forwardly angled writing positions, is retained.

The practicality of the writing desk 40 is enhanced by the provision therewith of a continuous supply of writing paper 48. The paper 48 is provided in a roll 50 rotatably mounted on a rod 51 extended between parallel projecting legs of a pair of angled brackets 52 fixed centrally to the undersurface of the desk 40 by screws or the like. The rod 51 will preferably have an enlarged head 53 on one end thereof engaging one bracket leg, and an opposed threaded end received through the second bracket leg and having a wing unit 54 threaded thereon for an adjustable tensioning of the paper roll through an inward flexing of the legs thereagainst. The paper 48 is fed from the roll over the upper edge of the desk 40 and centrally downward across the face thereof. The leading edge of the paper 48, for stabilization can be fed through a slot 55 through a bottom edge molding 56 on the desk. An appropriate fixed blade 57 is mounted on the undersurface of the desk below the molding slot 55 for use as a tear means for lengths of paper. The spacing of the blade 57 from the slot 55 assures a projecting tab on the leading end of the paper 48 for withdrawal of a new length. The upper portion of the paper 48, as it overlies the upper surface or writing surface of the desk 40, can be stabilized by a pivotally mounted holddown bar 58 pinned, as at 59, to the upper surface to one side of the paper for selectively swinging movement between a position completed retracted from the paper and a second position overlying and securing the paper. The bar 58 can include an appropriate manipulating handle 60.

Figure 2:
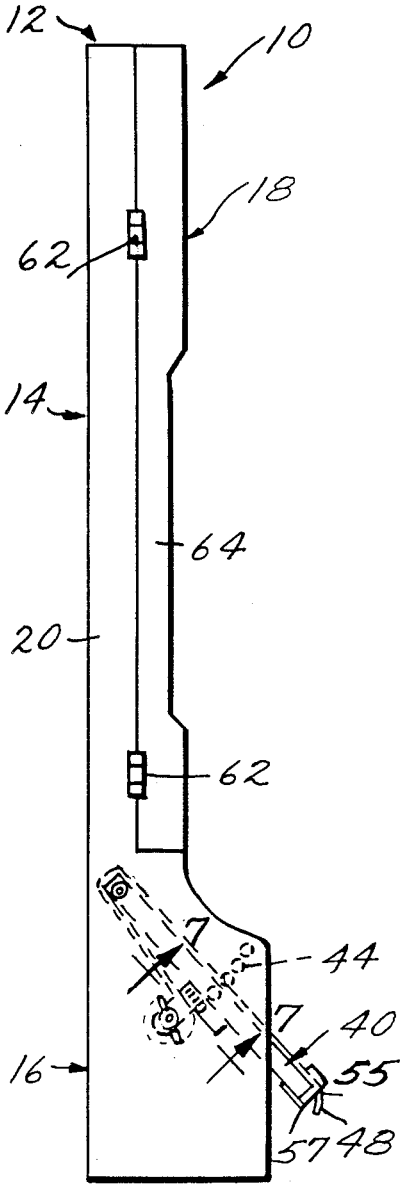
FIG. 2 is a side elevational view of the organizer.

The closure 18, mounted by appropriate hinge means 62, as noted in FIGS. 2 and 3, swings between a position fully opening the housing and the storage compartments therein, and a closed position overlying the open face of the housing and closing the compartments. The actual information-providing elements of the organizer 10 mount on the closure in an interrelating manner.

Structurally the closure comprises a vertically elongate rectangular frame coextensive with the upper section 14 of the housing 12 and including a pair of opposed vertical side rails 64, a bottom rail 66 and a top rail 68 all, in the closed position of the closure 18, coplanar respectively with the sides 20, lower shelf 36 and upper cross bar 22 of the housing 12.

A vertical elongate mounting panel 70 is mounted within the closure frame, preferably received within grooves defined within the inner faces of the side rails 64, bottom rail 66 and top rail 68. As noted in FIG. 4, the bottom rail extends forwardly of the mounting panel 70 sufficient to accommodate a groove or recess 71 for receiving pencils, pens, and the like immediately above the writing desk 40.

The mounting panel 70, in the lower portion thereof generally coextensive with the lower storage compartment 30, includes an enlarged substantially rectangular opening 72 cut therethrough. The opening 72 is provided with retaining means including a retaining flange 74 integral with the panel 70 and defined by a transverse section along the bottom of the opening, and a pair of opposed projections 75 extending inward from the opposed vertical edges of the opening at approximately mid height. Both the projections 75 and transverse flange forming section 74 are undercut from the rear of the panel 70 to define a narrow pocket 76 within the lower portion of the opening behind the retaining flange 74 and projections 75. The pocket 76 is completed by a transverse back or backing panel 78 overlying and secured to the rear face of the panel 70. The back panel 78 overlies a major portion of the opening 72 upward from the lower edge thereof, terminating in slight downwardly spaced relation to the upper edge of the opening to define a slot 80. This slot 80, upon a closing of the closure 18, and noting FIG. 4, aligns with the upper portion of the lower storage compartment 30 and provides an access slot for the introduction of materials, papers or the like, directly into the lower storage compartment 30 for retention therein behind the associated retaining members 37 and/or transverse strap 39.

As suggested in FIG. 1, the defined pocket 76 is particularly adapted to receive and display a calendar 82 above and in close proximity to the writing desk 40. The calendar will preferably comprise separate monthly sheets, each in the nature of an envelope or folder.

The panel 70, immediately above the opening 72, includes an aperture 84 defined centrally therethrough and configured to receive and mount a digital timepiece 86 capable of displaying both day and date. The location of the calendar 82 and timepiece 86 are such as to both be readily visible by and available to a user seated at the desk.

The panel 70, above the timepiece opening 84, is provided with a third transversely elongate opening 88. Immediately below the opening 88, and downward from the lower edge thereof, the rear surface of the panel 70 is provided with a series of rectangular recesses or pockets 90 cut or otherwise formed therein. These recesses 90 are adapted to receive stacks of reminder cards 92 as suggested in FIGS. 1 and 4. In order to properly retain the cards 92 within the pockets 90, an appropriate backing panel 94 is affixed to the rear surface of the panel 70 in overlying relation to the opening 88 and defined pockets 90 along the lower edge thereof. The height of the opening 88, and its depth as defined by the backing panel 94, are such as to allow free access to the pockets 90 for introduction and removal of the cards 92 in a manner and for a purpose to be described subsequently.

The information center is completed by an enlarged analog clock 96 incorporated into the upper portion of the panel 70 above the opening 88. The clock 96 can have the numerals provided, by painting, stenciling, or the like, directly on the front face of the panel 70 with the movement of the hands 98 controlled by an appropriate clock mechanism 100 mounted on the rear face of the panel 70 with the shaft thereof extending through the panel. The clock 96 is intended to be of a size visible throughout the living area.

As a proposed manner of utilizing the uniquely constructed information organizing system, unpaid bills, as they are received, are introduced through the access slot 80 into the lower storage compartment 30. The bills are retrievable upon an opening of the closure 18, facilitated if desired by a hand grip 102. As the bills are paid, they are stored within the monthly calendar envelope or folder. At the end of the month, the calendar folder, for example the displayed August folder in FIG. 1, is removed and, with the stored paid bills therein, positioned in the intermediate storage compartment 32 wherein it is retained, with the previous monthly calendar folders and paid bills, for year-end and tax reconciliation. As will be appreciated, it is contemplated that a full year of calendar sheets, preferably individual folders with month calendars defined on the front faces thereof, will be stored in the lower pocket defined by the opening 72.

Figure 5:
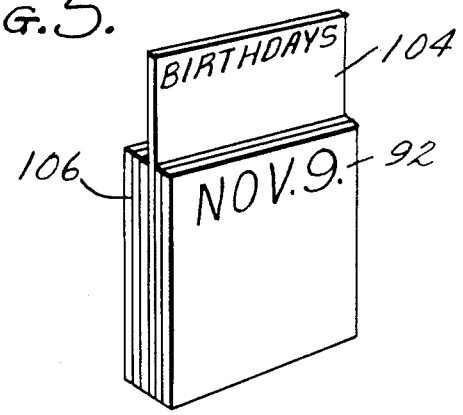
FIG. 5 is a perspective view detailing a packet of cards from the date reminder section of the organizer.

The cards 92, of any appropriate durable material such as cardboard or plastic, are specifically intended for use as visual reminders of important days and/or dates. As an example, and noting FIG. 5 in particular, if a record is to be maintained of birthdays to be remembered, the pack of cards will be so designated by a single labeling card 104 of greater height than the reminder cards 92 and will be placed behind the reminder cards 92 in one of the recessed pockets 90. The reminder cards 92 themselves will each include the date of the particular occasion, i.e. birthday, and such other information as may be desired, including the name and address of the party involved. The cards will be stacked forward of the labeling card 104 in sequence whereby as each date is arrived at, as will be recognized by a comparison of the date on the card with both the digital timepiece 86 and the calendar 82, that card is moved to the rear of the stack, immediately forward of the labeling card 104. In this manner, the subsequent important date will be exposed. As desired, blank cards 106 for future use may be stored within the appropriate pocket 90 immediately behind the labeling card 104. It will of course be appreciated that the thickness of the cards has been substantially exaggerated for purposes of illustration. As a practical matter, a substantial number of very thin cards will be accommodated in the card pockets 90.

Other possible uses for the reminder cards can be anniversaries, appointments, days of the week, etc.

The uppermost storage compartment 34 in the housing 12, accessible upon an opening of the closure 18, is intended for use in storing pre-purchased birthday cards, anniversary cards and other such special occasion materials as will normally be used in conjunction with the reminder card dates, whereby an appropriate supply of such special occasion cards will be available at all times. It will be appreciated that this storage compartment can be used for other purposes such as a container for writing materials.

As an alternative to mounting the closure 18 on the external hinges 62, and noting FIG. 8, the housing side boards 20, top board 22 and lowermost shelf 36 can be extended slightly forward with the closure 18 recessed therein and hinge-mounted by upper and lower projecting hinge pins 63. The pins 63 can engage either directly into the mounting panel 70 or in a narrow rectangular frame thereabout.

As desired, and as suggested in FIG. 3, the side walls of the housing 20 provide for a convenient means for mounting a wall phone 108 immediately adjacent the writing desk 40.

From the foregoing, it will be appreciated that the described information center incorporates multiple interrelated components in a compact relationship to each other utilizing a single self-contained structure capable of being wall mounted for maximum space utilization.

What is claimed is:

1. An organizer comprising a vertically elongate housing with an open front, a mounting panel generally coextensive with said open front of the housing, means for pivotally mounting said mounting panel on said housing for selective movement outward relative to the housing to an open position remote from said open front, said mounting panel having a front face for display of a multiple information-providing components, and a rear face, said information-providing components including clock means mounted on said panel and displayed on said front face, at least one display pocket, said at least one display pocket comprising a recess formed in the mounting panel through the rear face, said recess being of a depth to receive multiple stacked sheet-like information elements with display faces directed toward the front face of the mounting panel, and an opening through the front face of the mounting panel generally aligned with said recess for display of a recess-received element, said recess extending laterally beyond said opening inward of said front face of said mounting panel for retention of said elements against unrestricted withdrawal through said opening, a backing panel engaged over the rear of the recess at the rear face of the mounting panel for retention of the elements, and multiple storage components mounted inward of said mounting panel for concealment within said housing.

2. The organizer of claim 1 including an access slot defined through said mounting panel in alignment with one of said storage compartments for the selective introduction of sheet-like information elements and the like through the front face of the mounting panel and into the aligned storage compartment.

3. The organizer of claim 2 including desk means pivotally mounted below said at least one display pocket, and means for mounting said desk means for movement between a stored position and a writing position.

4. The organizer of claim 1 including desk means pivotally mounted below said at least one display pocket, and means for mounting said desk means for movement between a stored position and a writing position.

5. The organizer of claim 1 wherein said clock means includes a time display clock vertically above said at least one pocket, and a separate date display clock below said time display clock.

* * * * *